United States Patent [19]

Sorenson

[11] 4,417,109

[45] * Nov. 22, 1983

[54] SWITCH CONSTRUCTION

[75] Inventor: Richard W. Sorenson, Avon, Conn.

[73] Assignee: Carlingswitch, Inc., West Hartford, Conn.

[ * ] Notice: The portion of the term of this patent subsequent to Aug. 31, 1999 has been disclaimed.

[21] Appl. No.: 341,706

[22] Filed: Jan. 22, 1982

Related U.S. Application Data

[63] Continuation-in-part of Ser. No. 234,664, Feb. 11, 1981, Pat. No. 4,347,417.

[51] Int. Cl.[3] ..... H01H 5/06

[52] U.S. Cl. ..... 200/68

[58] Field of Search ..... 200/676, 68, 241, 252, 200/260

[56] References Cited

U.S. PATENT DOCUMENTS

| | | | |
|---|---|---|---|
| 2,874,338 | 2/1959 | Pease | 200/68 |
| 2,966,560 | 12/1960 | Gluck | 200/67 G |
| 3,035,134 | 5/1962 | Hults | 200/67 G |
| 3,541,280 | 11/1970 | Farrell | 200/67 G |
| 3,711,663 | 1/1973 | Sorenson | 200/67 G |
| 4,347,417 | 8/1982 | Sorenson | 200/67 G |

FOREIGN PATENT DOCUMENTS

| | | | |
|---|---|---|---|
| 2847772 | 5/1979 | Fed. Rep. of Germany | 200/67 G |
| 2447086 | 9/1980 | France | 200/252 |

*Primary Examiner*—John W. Shepperd

*Attorney, Agent, or Firm*—McCormick, Paulding & Huber

[57] ABSTRACT

A plastic switch actuator is fitted with a spring so as to impart sliding and rocking motion to a movable contact by virtue of direct enagement between spring and element. The actuator may be slidably or pivotally supported in the swtich case and has a depending integral portion received in an opening of the element but it is the spring which keeps the element in contact with the fixed switch contacts. Other embodiments provide for illuminating the rocker in the miniature switch made possible by this simplified switch construction of fewer component parts. Still further embodiments provide for a toggle style actuator having a movable contact capable of retention in a "center-off" position wherein the movable contact is releasably retained on shelf-like lands defined for this purpose in the switch base, and wherein this contact can be moved by the depending actuator portion through joint action by the actuator and the spring provided on said actuator.

5 Claims, 2 Drawing Figures

SWITCH CONSTRUCTION

CROSS REFERENCE TO RELATED APPLICATIONS

This application is a continuation-in-part of Ser. No. 234,664, filed Feb. 11, 1981 now U.S. Pat. No. 4,347,417 dated Aug. 31, 1982. This patent is incorporated by reference herein and assigned to the assignee herein. The term of the patent to issue from this application will be shortened to expire concurrently with that of U.S. Pat. No. 4,347,417.

This invention relates generally to electrical switches having bases of an insulating material and with two or more fixed electrical contacts in the lower wall thereof. A movable contact element bridges selected ones of these fixed contacts, being movable through the actuator also of insulating material. The present invention deals more particularly with a unique configuration and location for the actuator and an associated spring whereby sliding actuator motion causes the required pivoted and translational movement of the movable contact element across the fixed contacts without necessity for relatively reciprocable intermediate parts or components.

The description to follow has been restricted to include only the subject matter added by way of continuation and FIGS. 1–20 have been deleted from the drawings for the same reason.

Figure 1:
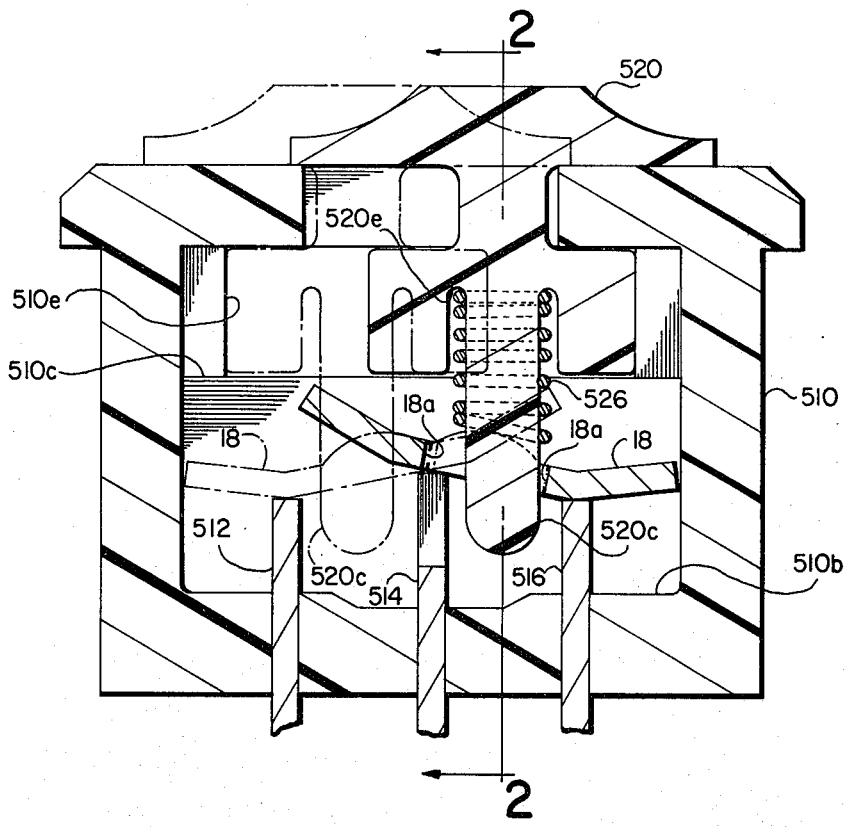
FIG. 1 is a vertical sectional view through a switch constructed in accordance with a preferred embodiment of the present invention.
Figure 2:
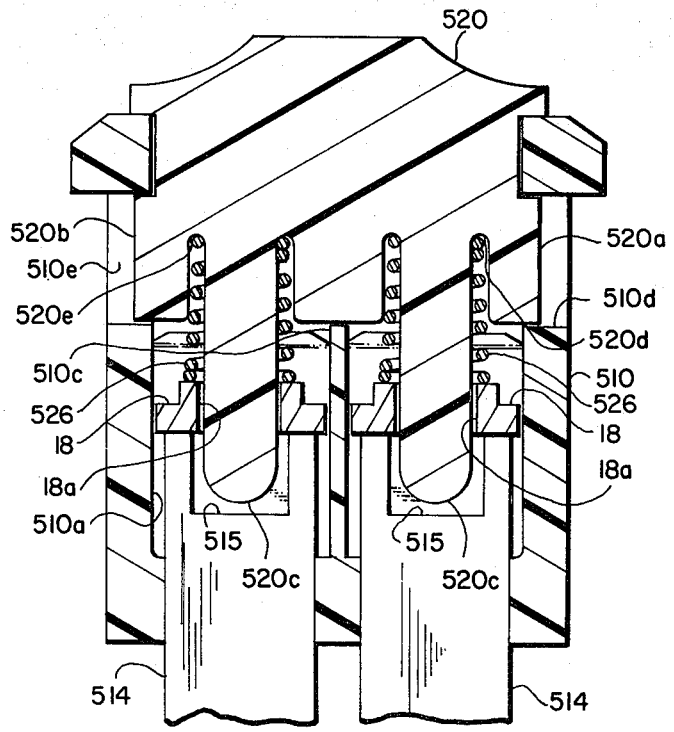
FIG. 2 is a sectional view taken generally on the line 2—2 of FIG. 1.

FIGS. 1 and 2 show a preferred switch construction incorporating many of the advantages from the switch construction of U.S. Pat. No. 4,347,417. The switch base 510 has a cavity 510*a* with a bottom wall 510*b* in which at least two and preferably three fixed contacts are provided. The center contact 514 has a yoke shaped upper end 515 and two end contacts 512 and 516 spaced therefrom as best shown in FIG. 2 herein. FIG. 2 shows a two pole switch construction but it will be apparent that one pole could be provided as well. A web-like wall portion 510*c* divides the cavity 510*a* into two subcavities in the two pole switch construction shown in FIGS. 1 and 2.

The movable contact elements 18, 18 are identical to those described above with reference to FIG. 3 in U.S. Pat. No. 4,347,417. Springs 526, 526 act against these elements to cause them to bridge center contacts 514, 514 and either of the two end contacts 512 and 516 as described above with reference to FIGS. 1–3 in U.S. Pat. No. 4,347,417.

The switch of FIGS. 1 and 2 has actuator means 520 movably supported in the switch case 510, and more particularly has support means in the form of buttons 520*a*, 520*b* which fit into support regions or slots 510*d* and 510*e* respectively, so that the actuator 520 can slide between the positions illustrated for it in the solid and broken lines of FIG. 1.

As in the rocker switch embodiment of FIGS. 1–3 in U.S. Pat. No. b 4,347,417, the slide switch embodiment of FIGS. 1 and 2 has a depending portion 520*c* of actuator 520 loosely received in openings 18*a*, 18*a* of movable contact elements 18, 18 such that these elements can pivot as they are moved between the positions illustrated for them in FIG. 1. Springs 526 urge these contact elements 18, 18 into engagement with the fixed center contacts 514, 514 and with the end contacts 512 or 516 depending upon the position of actuator 520. Annular recesses 520*e* and 520*d* serve to retain the upper ends of these springs 526, 526 during such sliding motion of actuator 520.

I claim:

1. A switch comprising a base of insulating plastic and defining an upwardly open cavity, a plurality of fixed contacts spaced along the bottom wall of said base cavity, said switch having means defining actuator support regions, actuator means including support means cooperating with said support regions to slidably support said actuator, said actuator means including a depending portion, a movable contact element slidably received inside said switch base cavity for movement generally across the upper ends of certain of said spaced contacts to selectively bridge said certain fixed contacts, spring means retained by said depending actuator portion and engaging said movable contact element to bias said movable element in engagement with said fixed contacts, said movable contact element having at least one upwardly open recess to loosely receive the lowermost end of said depending actuator portion and said movable contact element having portions adjacent said recess for engaging said spring means during actuator movement, whereby said element is moved in response to such actuator movement.

2. The switch according to claim 1 wherein one of said plurality of fixed contacts has a planar upstanding portion in said switch base cavity, said planar portion being so oriented that its uppermost edge engages the underside of said movable conact, and said dpending actuator end portion adapted to move through the plane of said upstanding planar portion during movement of said movable contact element responsive to said actuator movement.

3. The switch according to claim 2 wherein said movable contact element recess for receiving said depending actuator end portion comprises an opening through said contact element, said depending portion loosely received in said opening to permit rocking motion of said contact element as it moves over said upstanding portion of said one fixed contact.

4. The switch according to claim 3 wherein said actuator means is molded from plastic and wherein said support means for movable supporting said actuator comprises projections integrally formed in said plastic actuator, said projections received in complementary shaped openings in side wall means defined by said plastic base, said depending portion also integrally formed as part of said plastic actuator, said spring means having a lower end engaging said movable contact element and an upper end engaging a downwardly facing surface also integrally defined in said actuator.

5. The switch according to claim 1 wherein said actuator defined support means for movably supporting said actuator comprises integrally formed projections received in complementary shaped openings in side wall means defined by said plastic base, said depending portion also integrally formed as part of said actuator, said spring means having a lower end engaging said movable contact element and an upper end engaging a downwardly facing surface also integrally defined in said actuator.

* * * * *